US010109140B1

(12) United States Patent
Spencer

(10) Patent No.: US 10,109,140 B1
(45) Date of Patent: Oct. 23, 2018

(54) THROUGH-WALL COLLECTION CANISTER

(71) Applicant: Wayne Spencer, Lutz, FL (US)

(72) Inventor: Wayne Spencer, Lutz, FL (US)

( * ) Notice: Subject to any disclaimer, the term of this patent is extended or adjusted under 35 U.S.C. 154(b) by 0 days.

(21) Appl. No.: 15/947,465

(22) Filed: Apr. 6, 2018

(51) Int. Cl.
*G07D 11/00* (2006.01)
*E05C 19/00* (2006.01)
*G09F 3/18* (2006.01)

(52) U.S. Cl.
CPC ..... *G07D 11/009* (2013.01); *E05C 19/003* (2013.01); *G09F 3/18* (2013.01)

(58) Field of Classification Search
CPC ..... A45C 1/12; G07D 11/009; E05C 19/003; G09F 3/18; E05G 1/005; E05G 1/026
USPC .... 232/4 R, 1 E, 1 D, 19, 44, 43.2; 220/476, 220/480, 481; 109/66, 73
See application file for complete search history.

(56) References Cited

U.S. PATENT DOCUMENTS 6,920,835 B1 * 7/2005 Johnson ..... E05G 7/001 109/59 R
7,185,802 B2 3/2007 Spencer
7,389,910 B2 6/2008 Spencer
7,431,200 B2 * 10/2008 Nordgren ..... G06Q 99/00 232/1 D
7,850,065 B2 * 12/2010 Lederer ..... A47G 33/00 109/74
8,646,682 B1 2/2014 Spencer
8,651,367 B1 2/2014 Spencer
D707,015 S 6/2014 Spencer
D708,815 S 7/2014 Spencer
8,777,098 B1 7/2014 Spencer

* cited by examiner

*Primary Examiner* — William L Miller
(74) *Attorney, Agent, or Firm* — Edward P. Dutkiewicz

(57) ABSTRACT

There is an outer component and an inner component and a donation container. The outer component has a donation passageway with a grate section for passing liquid to the bottom of the device. There is a donation container which is locked in position with a pair of locking bars, secured with a padlock. There is a donation container frame which may be taken apart to removed jammed material from the donation passageway and donation container.

12 Claims, 7 Drawing Sheets

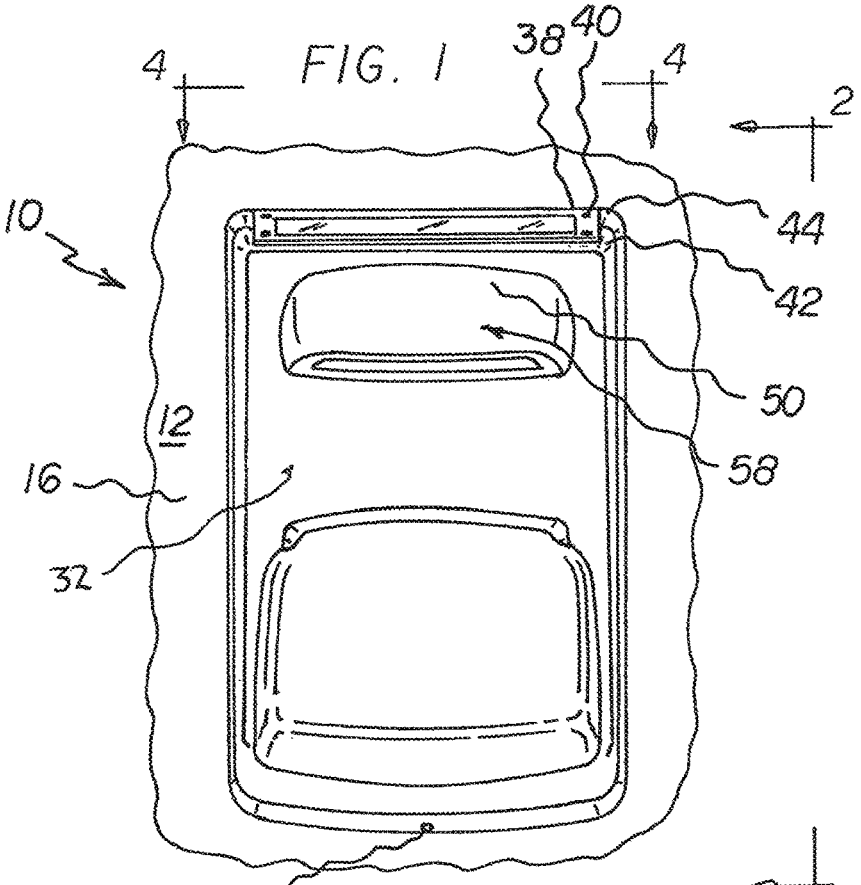
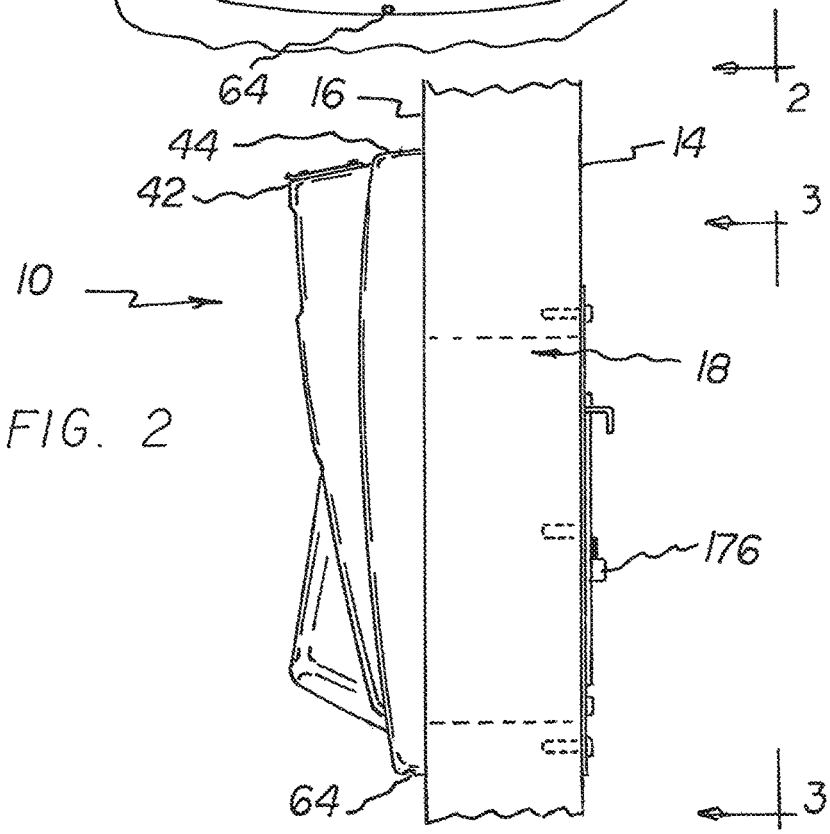
FIG. 2

FIG. 3
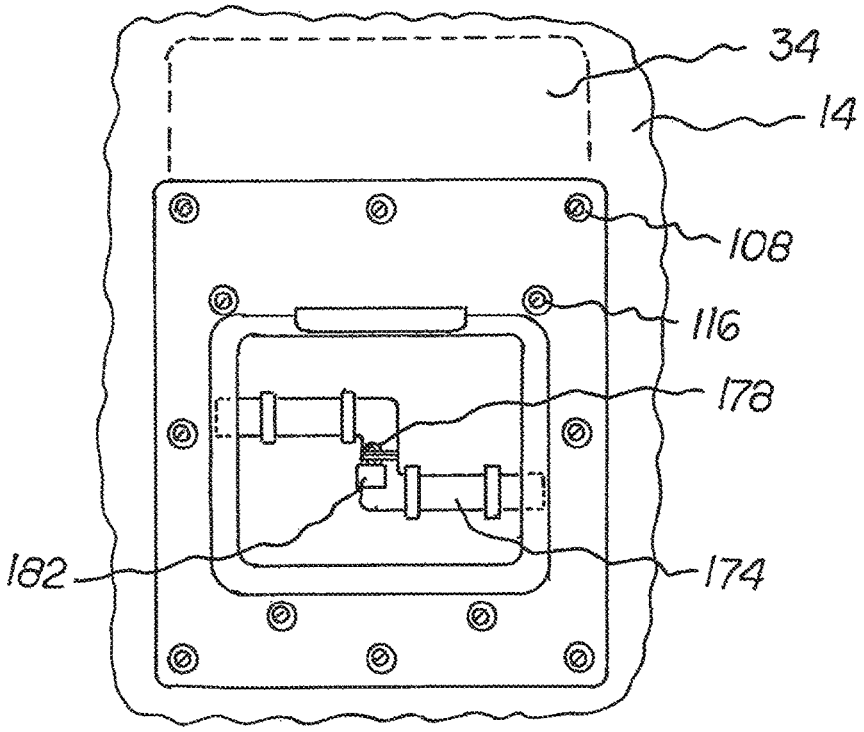
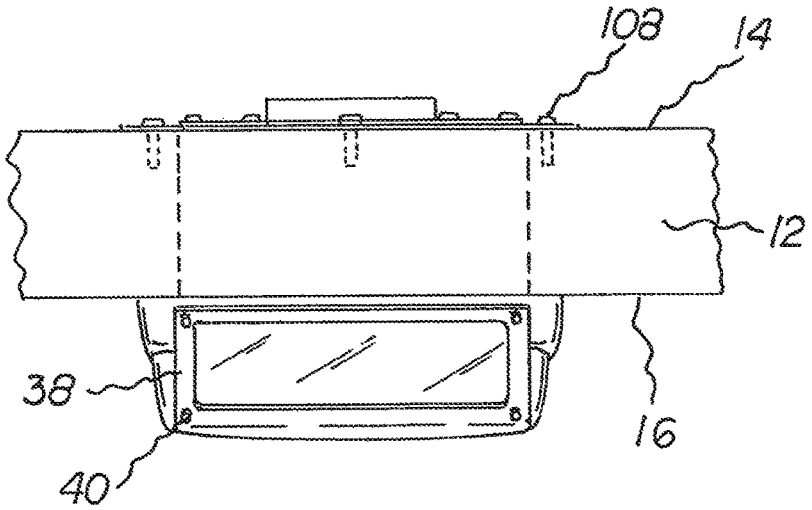
FIG. 4

FIG. 10
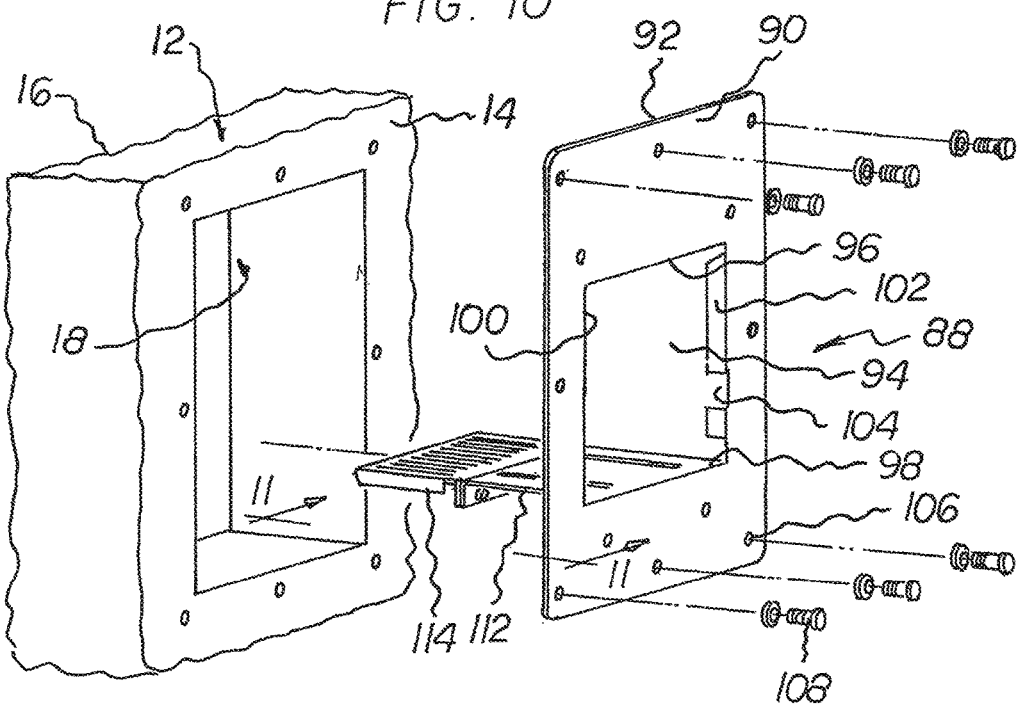
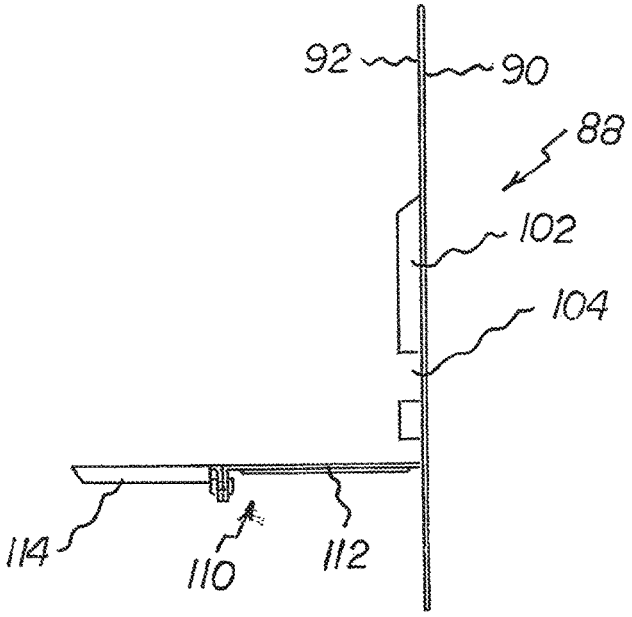
FIG. 11

THROUGH-WALL COLLECTION CANISTER

RULE 1.78(F)(1) DISCLOSURE

The Applicant has not submitted a related pending or patented non-provisional application within two months of the filing date of this present application. The invention is made by a single inventor, so there are no other inventors to be disclosed. This application is not under assignment to any other person or entity at this time.

BACKGROUND OF THE INVENTION

Field of the Invention

The present invention relates to a through-wall collection canister and more particularly pertains to an improved collection canister for drive-thru application.

Description of the Prior Art

The use of collection canisters is known in the prior art. More specifically, collection canisters previously devised and utilized for the purpose of accepting donations from the general public are known to consist basically of familiar, expected, and obvious structural configurations, notwithstanding the number of designs encompassed by the prior art which has been developed for the fulfillment of countless objectives and requirements.

While the prior art devices fulfill their respective, particular objectives and requirements, the prior art does not describe through-wall collection canister that allows an improved collection canister.

In this respect, the through-wall collection canister according to the present invention substantially departs from the conventional concepts and designs of the prior art, and in doing so provides an apparatus primarily developed for the purpose of providing an improved collection canister.

Therefore, it can be appreciated that there exists a continuing need for a new and improved through-wall collection canister which can be used the collection of donations in a drive-thru application. In this regard, the present invention substantially fulfills this need.

SUMMARY OF THE INVENTION

In view of the foregoing disadvantages inherent in the known types of collection canisters now present in the prior art, the present invention provides an improved through-wall collection canister. As such, the general purpose of the present invention, which will be described subsequently in greater detail, is to provide a new and improved through-wall collection canister which has all the advantages of the prior art and none of the disadvantages.

In describing this invention, the word "coupled" is used. By "coupled" is meant that the article or structure referred to is joined, either directly, or indirectly, to another article or structure. By "indirectly joined" is meant that there may be an intervening article or structure imposed between the two articles which are "coupled". "Directly joined" means that the two articles or structures are in contact with one another or are essentially continuous with one another.

By adjacent to a structure is meant that the location is near the identified structure.

To attain the goals of making a collection canister for drive-thru applications, the present invention essentially comprises a through-wall collection canister. The invention comprises several components, in combination, and is herein described.

There is an existing wall which has an interior surface and an exterior surface. The existing wall has an opening there through. The opening through the existing wall has a rectangular configuration. The hole through the existing wall passes from the exterior surface of the wall to the interior surface of the wall. The hole size is generally about twelve inches in height and twelve inches in width. The hole may be of smaller dimensions and the hole may be of greater dimensions, in that the hole is sized to fit the application.

There is an outer component. The outer component is fabricated of a polymeric material. The outer component has an external portion and an in-wall portion. The outer component external portion has a top surface, a bottom surface, two side surfaces, a front surface, and a rear surface. The top surface has a message area with message frame. The message frame has a plurality of message frame fasteners for securing the message frame to the top surface. The top surface has a forward lip and a pair of oppositely located side lips.

The outer component external portion has an interior. The interior of the outer component external portion has a donation passageway there through. The donation passageway is formed by an upper internal surface, a lower internal surface, and a pair of internal side surfaces. The passageway also has an internal rear surface.

The donation passageway has an upper end which forms an opening which is located on the front surface of the outer component external portion. The donation passageway has a lower end forming an opening. The donation passageway terminates within the in-wall portion. The outer component external portion has an interior lowermost extent which forms a drainage cavity. The drainage cavity has a drain hole, for allowing water and other liquid material to be drained from the interior of the outer component.

The outer component in-wall portion is sized to fit within the hole made in the existing wall. The outer component external portion is coupled to the exterior surface of the exiting wall.

The outer component in-wall portion has an upper surface, a lower surface, a top surface, a bottom surface, and a rear surface. The rear surface has a generally central recess therein. There is an edge recess which is a recess in both the top surface and the rear surface. The rear surface central recess has an upper interior surface, a lower interior surface, a pair of interior side surfaces, a forward interior surface, and a rearward opening. The upper interior surface of the rear surface recess includes the outer portion external component donation passageway lower end opening.

In a variation of the embodiment, the outer component in-wall portion may have an internal vertical strut and an internal horizontal strut.

There is an inner component. The inner component is fabricated of a rigid material. The inner component has a generally rectilinear configuration with a inner surface and a generally parallel outer surface. The inner component has a pass-through. The pass-through has an upper extent, a lower extent, and a pair of generally parallel side extents. Each side extent has an outwardly disposed locking lip. Each locking lip has a locking bar hole there through.

The inner component has a plurality of bolt holes there through, with a plurality of associated inner component outer component bolts and a plurality of associated wall securing bolts.

There is an interior wall gasket. The interior wall gasket is fabricated of an elastomeric material. The interior wall gasket has a generally rectangular configuration. The gasket has an opening there through. The interior wall gasket is located between the inner component and the existing wall interior surface.

There is a donation container. The donation container is fabricated of a rigid material. The donation container has a generally rectilinear configuration, with an outer surface, an inner surface, a pair of generally parallel side surfaces, and a bottom surface. The donation container has an open top, with the open top having a continuous outwardly disposed lip.

Each side surface has a pair of raised mounting surfaces, with each mounting surface having at least one threaded mounting bolt hole. Each mounting bolt hole has an associated donation container mounting bolt.

There is a donation container frame. The donation container frame is fabricated of a rigid material. The donation container frame has a drawer face portion and a pair of outwardly disposed donation container holders. Each donation container holder has at least one slot there through.

The drawer face portion has an inner surface and an outer surface, with a thickness there between. The thickness forms an edge. The donation container frame edge has a top section, a bottom section, and a pair of generally parallel side section. The drawer face portion has a recess therein. The recess has a plurality of locking bar holders. The recess has a pair of locking bar holes there through. The recess has a pair of associated locking bars, with each locking bar having an outer extent and an inner extent. The locking bars, inner extents, each have a lock tab. Each lock tab has a lock hole there through. The drawer face portion recess has a plurality of bolt holes there through, for securing the donation container holders to the drawer face portion.

In use, a hole is cut in the existing wall. The hole is sized to accept the in-wall portion of the outer component. The outer component is fixed to the wall, usually with bolts. The outer component is positioned so that the lip of the top surface deflects water or moisture away from the opening which is located on the front face of the outer component. In side of the building, on the interior surface of the wall, the inner component is fixed to the wall, so that the opening in the inner component is aligned with the recess in the in-wall portion of the outer component. Once fixed to the wall, the donation container is inserted through the inner component, and is nested within the recess within the in-wall component. The donation container has a frame, which is attached, or coupled, to the donation container. The frame has a drawer face portion which is coupled to the donation container, thereby forming a drawer, which slides into the recess and is secured to the inner component by a locking bar arrangement. The locking bar arrangement is a pair of locking bars which pass through the locking bar holders which are located in the recess of the drawer face portion of the frame. The locking bars then pass through a slots on the side of the drawer face, and into the locking bar holes in the side extents of the inner component. The locking bars have an inwardly projecting tab with a lock hole there through, which allows each of the locking bars to be locked to one another, in an engaged position, with a single padlock.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved through-wall collection canister which has all of the advantages of the prior art collection canisters, and none of the disadvantages.

It is another object of the present invention to provide a new and improved through-wall collection canister which may be easily and efficiently manufactured and marketed.

It is further object of the present invention to provide a new and improved through-wall collection canister which is of durable and reliable constructions.

An even further object of the present invention is to provide a new and improved through-wall collection canister which is susceptible of a low cost of manufacture with regard to both materials and labor, and which accordingly is then susceptible of low prices of sale to the consuming public, thereby making such through-wall collection canister economically available to the buying public.

Even still another object of the present invention is to provide a through-wall collection canister for drive-thru applications.

Lastly, it is an object of the present invention to provide a new and improved through-wall canister. There is an outer component and an inner component and a donation container. The outer component has a donation passageway with a grate section for passing liquid to the bottom of the device. There is a donation container which is locked in position with a pair of locking bars, secured with a padlock. There is a donation container frame which may be taken apart to removed jammed material from the donation passageway and donation container.

It should be understood that while the above-stated objects are goals which are sought to be achieved, such objects should not be construed as limiting or diminishing the scope of the claims herein made.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is front elevational view of the canister installed on an existing wall.

FIG. 2 is a view taken along line 2-2 of FIG. 1.

FIG. 3 is a view taken along line 3-3 of FIG. 2.

FIG. 4 is a view taken along line 4-4 of FIG. 1.

FIG. 10 is a perspective exploded view of the inner component and an existing wall.

FIG. 11 is a side elevational view of the inner component.

The same reference numerals refer to the same parts throughout the various Figures.

DESCRIPTION OF THE PREFERRED EMBODIMENT

Figure 5:
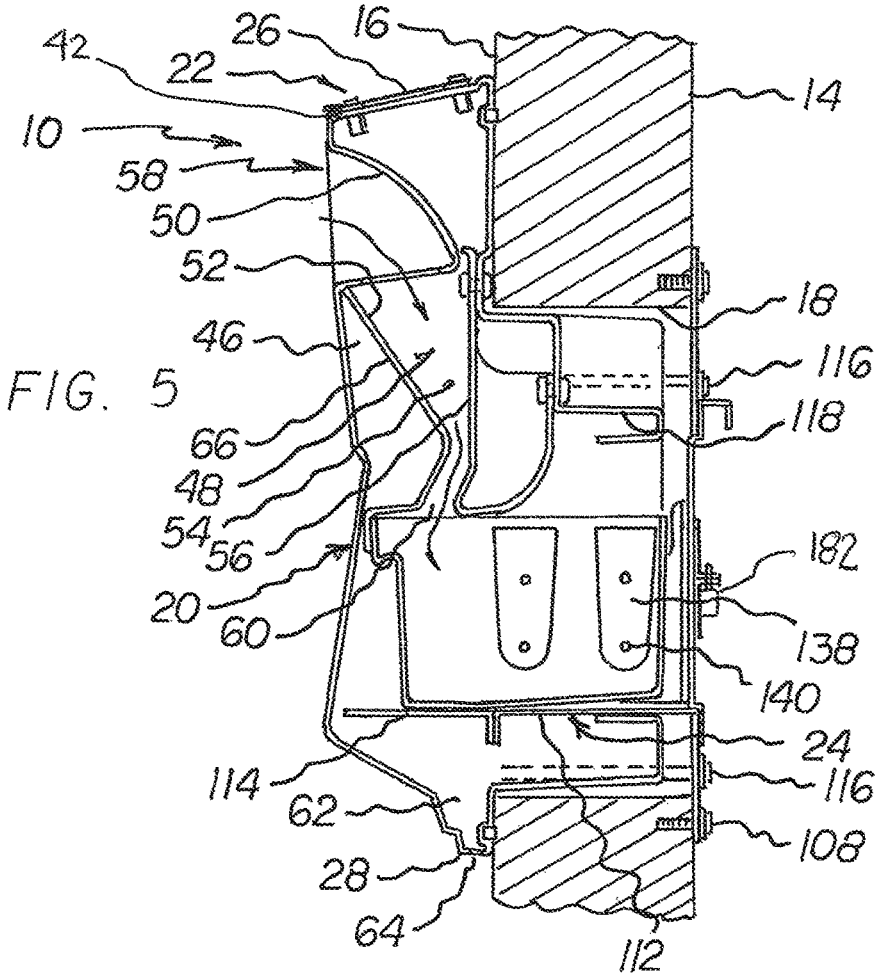
FIG. 5 is a cross sectional side view of the collection canister.
Figure 6:
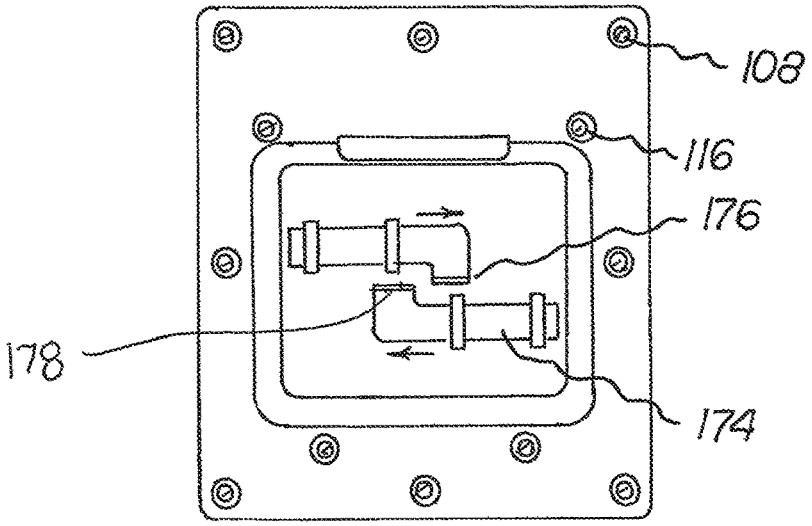
FIG. 6 is a view of the inner surface of the inner component of the through-wall collection canister.
Figure 7:
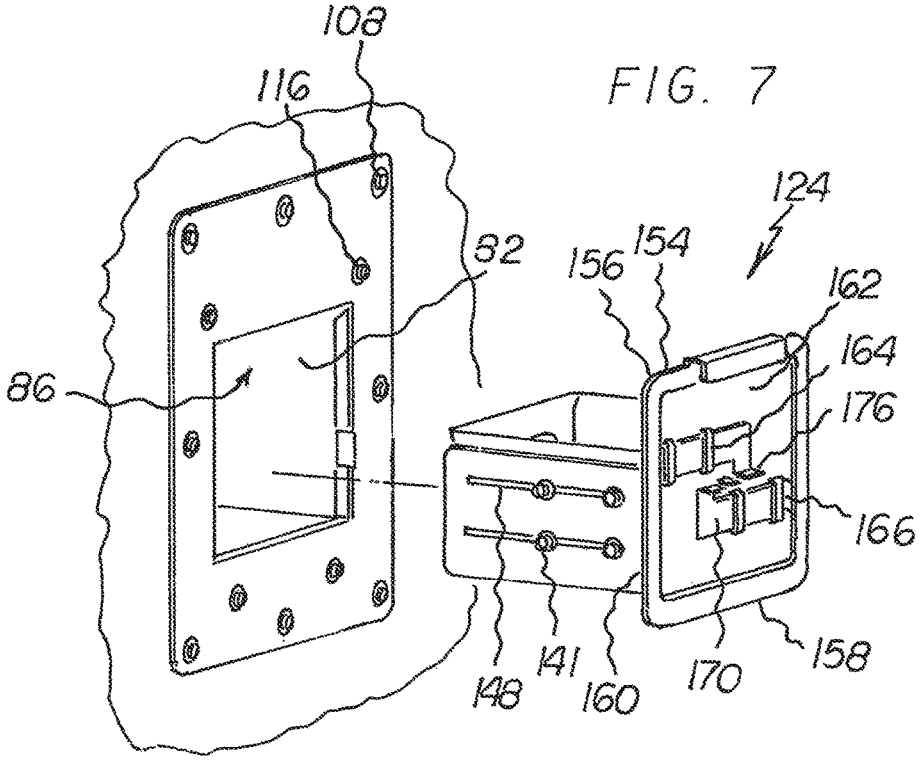
FIG. 7 is a perspective disassembled view of the inner component and the donation container and frame.
Figure 8:
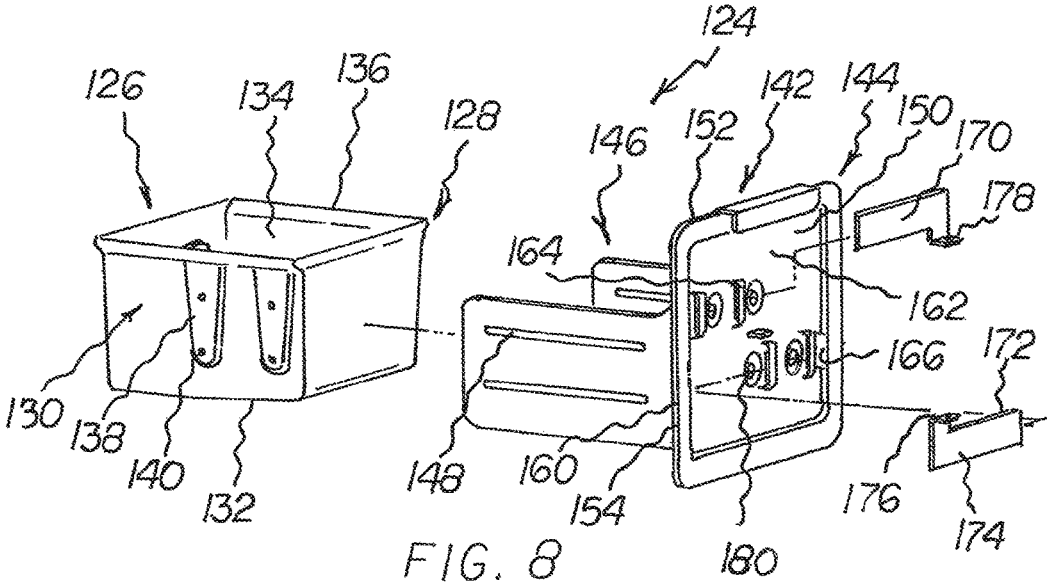
FIG. 8 is a perspective exploded view of the donation container and donation container frame.
Figure 9:
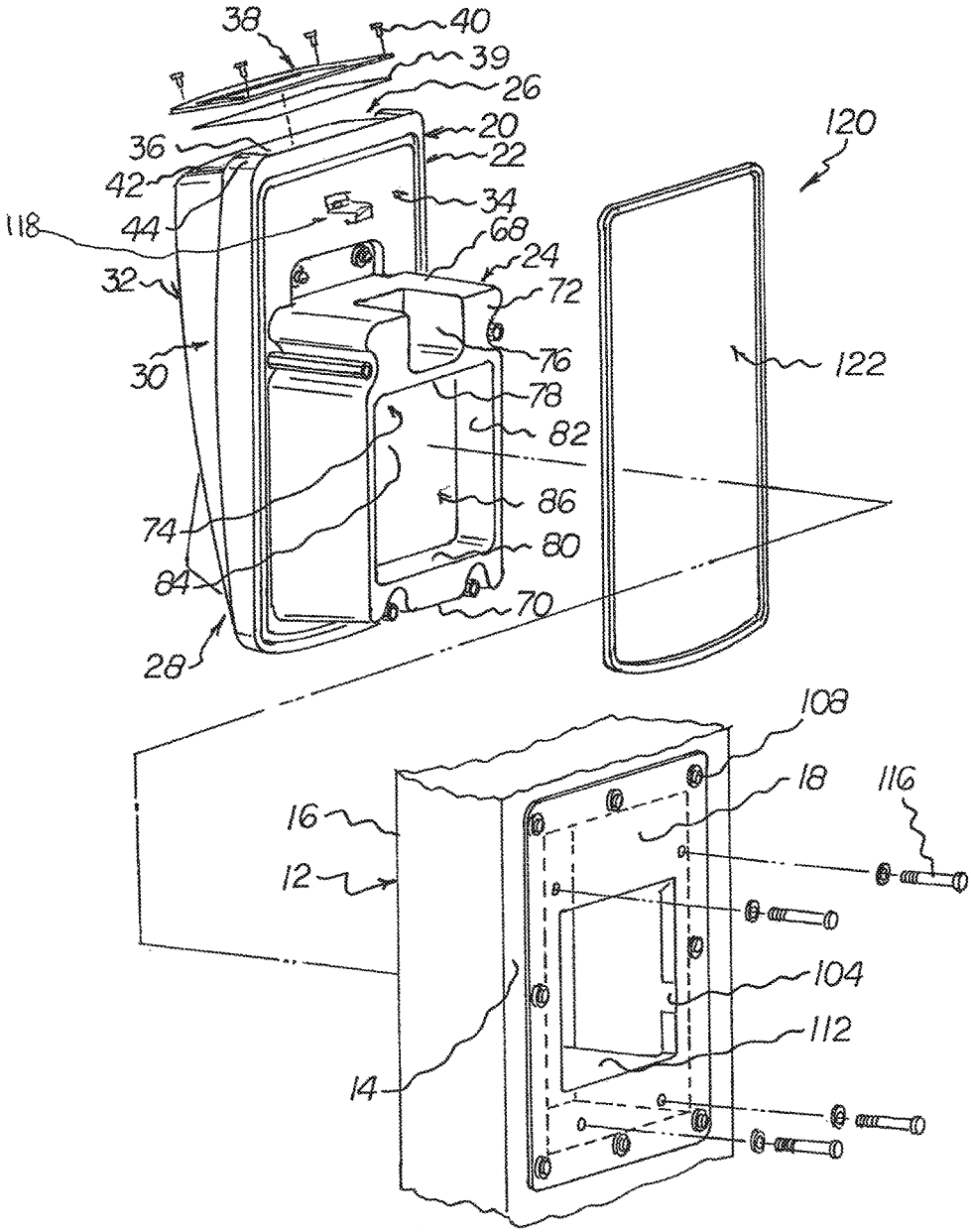
FIG. 9 is a perspective exploded view of the through-wall collection canister.
Figure 12:
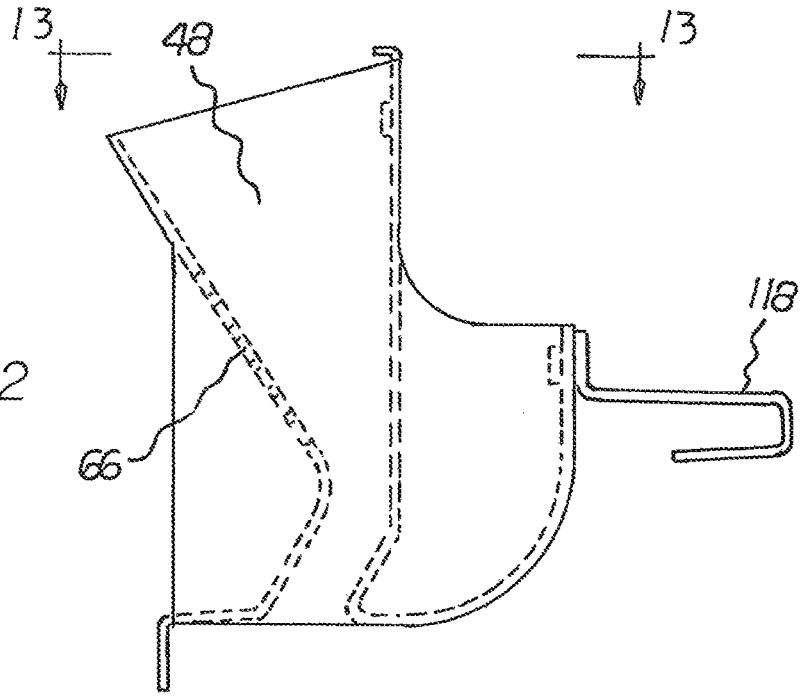
FIG. 12 is a partial view of a cross section of the donation passageway of the outer component showing the conation passageway and the strut.
Figure 13:
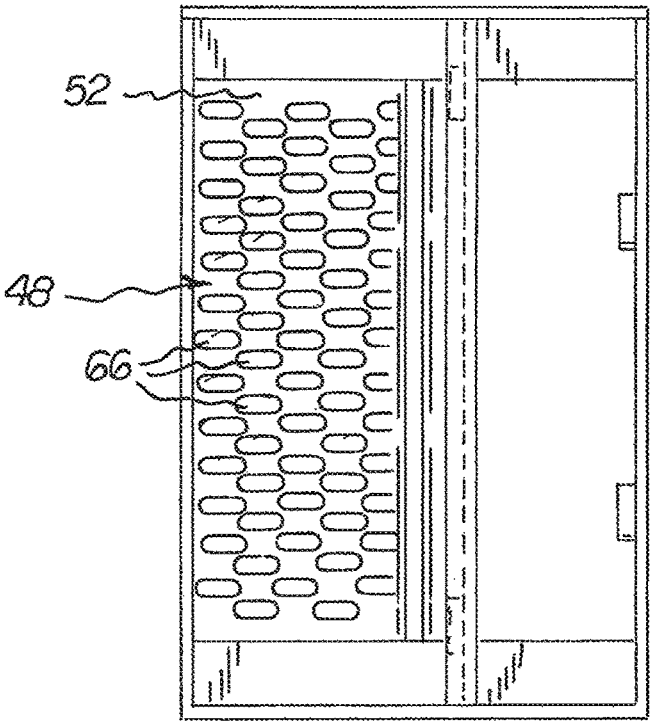
FIG. 13 is a view taken along line 13-13 of FIG. 12. Note the grates, or drainage holes, on the lower surface of the donation passageway, which allow moisture, as well as liquids, to pass through the device, and be drained away through the drain hole in the bottom of the outer component.

With reference now to the drawings, and in particular to FIG. 1 thereof, the preferred embodiment of the new and improved through-wall collection canister embodying the principles and concepts of the present invention and generally designated by the reference numeral 10 will be described.

The present invention, the through-wall collection canister 10 is comprised of a plurality of components. Such components in their broadest context include an outer component, an inner component, a donation container and a donation container frame. Such components are individually configured and correlated with respect to each other so as to attain the desired objective.

A through-wall collection canister 10, comprising, in combination, is herein described.

There is an existing wall 12 which has an interior surface 14 and an exterior surface 16. The existing wall has an opening 18 there through. The opening through the existing wall has a rectangular configuration. The hole through the existing wall passes from the exterior surface of the wall to the interior surface of the wall. The hole size is generally about twelve inches in height and twelve inches in width. The hole may be of smaller dimensions and the hole may be of greater dimensions, in that the hole is sized to fit the application and receive the in-wall portion of the outer component.

There is an outer component 20. The outer component is fabricated of a polymeric material, such as a plastic, cut may be made of a metal. The outer component has an external portion 22 and an in-wall portion 24. The outer component external portion has a top surface 26, a bottom surface 28, two side surfaces 30, a front surface 32, and a rear surface 34. The top surface has a message area 36 with message frame 38. A message 39 may be contained within the message frame and message area. The message frame has a plurality of message frame fasteners 40 for securing the message frame to the top surface. The top surface has a forward lip 42 and a pair of oppositely located side lips 44.

The outer component external portion has an interior 46. The interior of the outer component external portion has a donation passageway 48 there through. The donation passageway is formed by an upper internal surface 50, a lower internal surface 52, and a pair of internal side surfaces 54. The passageway also has an internal rear surface 56.

The donation passageway has an upper end 58 which forms an opening which is located on the front surface of the outer component external portion. The donation passageway has a lower end 60 forming an opening. The donation passageway terminates within the in-wall portion. The outer component external portion has an interior lowermost extent 62 which forms a drainage cavity. The drainage cavity has a drain hole 64, for allowing water and other liquid material to be drained from the interior of the outer component.

The lower internal surface of the passageway has a grating 66 for allowing liquids to drop from the passageway to the lowermost extent of the interior, so as to drained out of the through-wall collection canister.

The outer component in-wall portion is sized to fit within the hole made in the existing wall. The outer component external portion is coupled to the exterior surface of the exiting wall.

The outer component in-wall portion has an upper surface 68, a lower surface 70, and a rear surface 72. The rear surface has a generally central recess 74 therein. There is an edge recess 76 which is a recess in both the top surface and the rear surface. The rear surface central recess has an upper interior surface 78, a lower interior surface 80, a pair of interior side surfaces 82, a forward interior surface 84, and a rearward opening 86. The upper interior surface of the rear surface recess includes the outer portion external component donation passageway lower end opening.

In a variation of the embodiment, the outer component in-wall portion may have an internal vertical strut and an internal horizontal strut.

There is an inner component 88. The inner component is fabricated of a rigid material. The inner component has a generally rectilinear configuration with a inner surface 90 and a generally parallel outer surface 92. The inner component has a pass-through 94. The pass-through has an upper extent 96, a lower extent 98, and a pair of generally parallel side extents 100. Each side extent has an outwardly disposed locking lip 102. Each locking lip has a locking bar hole 104 there through.

The inner component has a plurality of bolt holes 106 there through, with a plurality of associated inner component outer component bolts and a plurality of associated wall securing bolts 108.

The inner component has a tray 110 which has a support portion 112 and a grated drain portion 114. The grated drain portion allows moisture which pass down the collection passageway and into the in-wall portion to be drained away to the lowermost extent of the outer component.

The inner component and the outer component are held together by a plurality of coupling bolts 116, which hold the outer component and the inner component together. The in-wall portion of the outer component has a strut 118, which is pressed between the in-wall portion and the inner component when the outer portion and the inner portion are drawn together by bolts. The outer component strut maintains a predetermined distance between the in-wall portion of the outer component and the inner component.

There is an interior wall gasket 120. The interior wall gasket is fabricated of an elastomeric material. The interior wall gasket has a generally rectangular configuration. The gasket has an opening 122 there through. The interior wall gasket is located between the inner component and the existing wall interior surface.

There is a donation container 124. The donation container is fabricated of a rigid material. The donation container has a generally rectilinear configuration, with an outer surface 126, an inner surface 128, a pair of generally parallel side surfaces 130, and a bottom surface 132. The donation container has an open top 134, with the open top having a continuous outwardly disposed lip 136.

Each side surface has a pair of raised mounting surfaces 138, with each mounting surface having at least one threaded mounting bolt hole 140. Each mounting bolt hole has an associated donation container mounting bolt 141.

There is a donation container frame 142. The donation container frame is fabricated of a rigid material. The donation container frame has a drawer face portion 144 and a pair of outwardly disposed donation container holders 146. Each donation container holder has at least one slot 148 there through.

The drawer face portion has an inner surface 150 and an outer surface 152, with a thickness there between. The thickness forms an edge 154. The donation container frame edge has a top section 156, a bottom section 158, and a pair of generally parallel side sections 160. The drawer face portion has a recess 162 therein. The recess has a plurality of locking bar holders 164. The recess has a pair of locking bar holes 166 there through. The recess has a pair of associated locking bars 170, with each locking bar having an outer extent 172 and an inner extent 174. The locking bars, inner extents, each have a lock tab 176. Each lock tab has a lock hole 178 there through. The drawer face portion recess has a plurality of bolt holes 180 there through, for securing the donation container holders to the drawer face portion. A padlock 182 is used to lock the locking bars together, with each locking bar engaged within the locking bar hole of the locking lip of the inner component.

In use, a hole is cut in the existing wall. The hole is sized to accept the in-wall portion of the outer component. The outer component is fixed to the wall, usually with bolts. The outer component is positioned so that the lip of the top surface deflects water or moisture away from the opening which is located on the front face of the outer component. In side of the building, on the interior surface of the wall, the inner component is fixed to the wall, so that the opening in the inner component is aligned with the recess in the in-wall portion of the outer component. Once fixed to the wall, the donation container is inserted through the inner component, and is nested within the recess within the in-wall component. The donation container has a frame, which is attached, or coupled, to the donation container. The frame has a drawer face portion which is coupled to the donation container, thereby forming a drawer, which slides into the recess and is secured to the inner component by a locking bar arrangement. The locking bar arrangement is a pair of locking bars which pass through the locking bar holders which are located in the recess of the drawer face portion of the frame. The locking bars then pass through a slots on the side of the drawer face, and into the locking bar holes in the side extents of the inner component. The locking bars have an inwardly projecting tab with a lock hole there through, which allows each of the locking bars to be locked to one another, in an engaged position, with a single padlock.

The grate holes in the donation passageway and in the inner component grate allow for water and other liquids to pass through the collection canister and out through the drainage hole in the bottom of the outer component.

Should there be any material which jams the drawer with the passageway, the inner donation container frame drawer face portion may be removed by first removing the lock, and the locking bars. This exposes the bolts which hold the frame to the donation container. This, then, allows the drawer face to be removed, and access gained to the donation container, so that the obstruction, blockage, or jamming material may be readily removed. This is an advantage over the existing prior art, which have single donation container, which, if jammed in position, may only be unjammed with difficulty, and in some instances, damage to the overall collection canister.

Another advantage of this configuration is the upper surface, forward lip, which deflects water, such as rainwater, from entering the device after having been shed by the top surface. The lip diverts the dripping water to the sides, and prevents water from entering the donation passageway. The side lips not only secure the display frame, but may also secure an information panel. If a user employs a vinyl strip as a message carrier, the vinyl strip may snap into the side lips of the top of the outer component, thereby obviating the frame and screws to secure the message strip in place.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A through-wall collection canister, comprising, in combination:

an outer component having an external portion and an in-wall portion, the external portion having a top surface and a bottom surface and two side surfaces, and a front surface and a rear surface, the outer component external portion having an interior having a donation passageway there through, the donation passageway having an upper end forming an opening there into and the donation passageway having a lower end forming an opening, the outer component in-wall portion having an upper surface and a lower surface and a top surface and a bottom surface and a rear surface;

an inner component having a generally rectilinear configuration with a inner surface and a generally parallel outer surface, the inner component having a pass-through, the inner component being coupled to the outer component; and a donation container having a generally rectilinear configuration with an outer surface and an inner surface and a pair of generally parallel side surfaces and a bottom surface, the donation container being located within the pass-through of the inner component.

2. The through-wall collection canister as described in claim 1, with the canister further comprising:

the outer component in-wall portion rear surface having a recess therein, the rear surface recess having an upper interior surface and a lower interior surface and a pair of interior side surfaces and a forward interior surface and a rearward opening, the upper interior surface of the rear surface recess including the outer portion external component donation passageway lower end opening;

the inner component pass-through having an upper extent and a lower extent and a pair of generally parallel side extents;

the donation container having an open top, the donation container being located within the outer component in-wall portion rear surface recess; and a donation container frame being coupled to the donation container.

3. The through-wall collection canister as described in claim 2, with the canister further comprising:

the outer component external portion donation passageway being formed by an upper internal surface and a lower internal surface and a pair of internal side surfaces; and each side extent of the inner component pass-through having an outwardly disposed locking lip.

4. The through-wall collection canister as described in claim 3, with the canister further comprising:

each locking lip of the inner component pass-through having a locking bar hole there through; and the donation container frame having a drawer face portion.

5. The through-wall collection canister as described in claim 4, with the canister further comprising:

the outer component top surface having a forward lip;

the outer component external portion donation passageway also having an internal rear surface; and the donation container frame having a pair of outwardly disposed donation container holders.

6. The through-wall collection canister as described in claim 5, with the canister further comprising:

the outer component top surface having a pair of oppositely located side lips; and the donation container frame having a pair of donation container holders with each holder having at least one slot there through, the drawer face portion having an inner surface and an outer surface with a thickness there between, the thickness forming an edge.

7. The through-wall collection canister as described in claim 6, with the canister further comprising:

the outer component top surface having a message area with message frame;

the inner component having a plurality of bolt holes there through with a plurality of inner component outer component bolts and a plurality of wall securing bolts;

each donation container side surface having a pair of raised mounting surface; and the donation container frame edge having a top section and a bottom section and a pair of generally parallel side sections, the donation container frame having a drawer face portion with the drawer face portion having a recess therein.

8. The through-wall collection canister as described in claim 7, with the canister further comprising:

the outer component external portion having an interior lowermost extent forming a drainage cavity;

an interior wall gasket fabricated of an elastomeric material;

the donation container open top having a continuous outwardly disposed lip;

each donation container mounting surface having at least one threaded mounting bolt hole with each donation container mounting bolt hole having an associated donation container mounting bolt; and the donation container frame drawer face portion recess having a plurality of locking bar holders, the recess having a pair of locking bar holes there through, the recess having a pair of associated locking bars, with each locking bar having an outer extent and an inner extent.

9. The through-wall collection canister as described in claim 8, with the canister further comprising:

the outer component top message frame having a plurality of message frame fasteners;

the outer component external portion drainage cavity having a drain hole;

the interior wall gasket having a generally rectangular configuration; and the donation container frame drawer face portion recess portion inner extent having a lock tab, with the lock tab having a lock hole there through.

10. The through-wall collection canister as described in claim 9, with the canister further comprising:

the outer component fabricated of a polymeric material;

the outer component in-wall portion having an internal vertical strut and an internal horizontal strut;

the interior wall gasket having an opening there through;

the inner component fabricated of a rigid material;

the donation container being fabricated of a rigid material;

the donation container frame being fabricated of a rigid material; and the donation container frame drawer face portion recess having a plurality of bolt holes there through for securing the donation container holders to the drawer face portion.

11. A through-wall collection canister comprising, in combination:

an outer component having an external portion and an in-wall portion, the external portion having a top surface and a bottom surface and two side surfaces and a front surface and a rear surface, the top surface having a lip, the front surface having a donation passageway there through, the donation passageway running within the outer component to the in-wall portion and terminating within the in-wall portion;

the outer component in-wall portion having a recess therein;

an inner component being coupled to the outer component; and a donation container having a donation container frame coupled thereto, the donation container contained within the outer component in-wall portion recess and passing through the inner component.

12. The through-wall collection canister as described in claim 11, with the canister further comprising the donation container frame having a drawer face portion with a recess therein, the donation container frame drawer face portion recess having a pair of slots therein, with the a pair of locking bars being coupled to the donation container frame drawer face portion recess, with each of the locking bars having a tab with a hole therein for the placement of a padlock.

* * * * *